US010258084B2

(12) United States Patent
Mironov et al.

(10) Patent No.: US 10,258,084 B2
(45) Date of Patent: Apr. 16, 2019

(54) SMOKING ARTICLE WITH REMOVABLE CAP

(71) Applicant: PHILIP MORRIS PRODUCTS S.A., Neuchatel (CH)

(72) Inventors: Oleg Mironov, Neuchatel (CH); Frederic Lavanchy, Grandson (CH); Alexis Louvet, Lausanne (CH); Andrea Carraro, Ins (CH); Johann Schmidt, Mindelau (DE)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 0 days.

(21) Appl. No.: 14/648,025

(22) PCT Filed: Dec. 6, 2013

(86) PCT No.: PCT/EP2013/075855
§ 371 (c)(1),
(2) Date: May 28, 2015

(87) PCT Pub. No.: WO2014/086998
PCT Pub. Date: Jun. 12, 2014

(65) Prior Publication Data

US 2015/0296882 A1 Oct. 22, 2015

(30) Foreign Application Priority Data

Dec. 7, 2012 (EP) ..... 12196141

(51) Int. Cl.
*A24F 47/00* (2006.01)
*A24C 5/54* (2006.01)
*A24D 1/00* (2006.01)

(52) U.S. Cl.
CPC ..... *A24F 47/006* (2013.01); *A24C 5/54* (2013.01); *A24D 1/00* (2013.01)

(58) Field of Classification Search
None
See application file for complete search history.

(56) References Cited

U.S. PATENT DOCUMENTS 1,963,738 A * 6/1934 Elow ..... A24D 1/042 131/331
3,770,155 A * 11/1973 Novitch ..... B65D 51/002 215/246

(Continued)

FOREIGN PATENT DOCUMENTS

CN 1040496 A 3/1990
CN 1059841 A 4/1992

(Continued)

OTHER PUBLICATIONS

Office Action dated Dec. 18, 2015 in Korean Patent Application No. 10-2015-7017092 (with English language translation).

(Continued)

*Primary Examiner* — Michael J Felton
(74) *Attorney, Agent, or Firm* — Oblon, McClelland, Maier & Neustadt, L.L.P.

(57) ABSTRACT

There is provided a smoking article having a mouth end and a distal end, the smoking article including a heat source positioned at the distal end; an aerosol-forming substrate adjacent to the heat source; and a cap configured to at least partially cover the heat source. The cap is attached at a line of weakness to the distal end, including a cylindrical plug of material circumscribed by a wrapper, and is removable to expose the heat source prior to use of the smoking article.

14 Claims, 2 Drawing Sheets

(56) References Cited

U.S. PATENT DOCUMENTS

| | | | | |
|---|---|---|---|---|
| 4,991,606 | A | 2/1991 | Serrano et al. | |
| 5,203,355 | A * | 4/1993 | Clearman | A24F 47/004 131/194 |
| 5,856,172 | A * | 1/1999 | Greenwood | C12N 1/04 435/243 |
| 2009/0065011 | A1 | 3/2009 | Maeder et al. | |

FOREIGN PATENT DOCUMENTS

| | | | | |
|---|---|---|---|---|
| EM | 001991126 | | 2/2012 | |
| EP | 1 993 388 | B1 | 8/2012 | |
| EP | 2 625 974 | A1 | 8/2013 | |
| EP | 2 625 975 | A1 | 8/2013 | |
| FR | 2622468 | A1 | 5/1989 | |
| GB | 810759 | A | 3/1959 | |
| GB | 1435504 | A * | 5/1976 | A24D 3/16 |
| JP | 2004-89125 | A | 3/2004 | |
| JP | 2008-35742 | A | 2/2008 | |
| JP | 2009-529872 | A | 8/2009 | |
| JP | 2010-535530 | A | 11/2010 | |
| RU | 1812955 | A3 | 4/1993 | |
| RU | 2 268 631 | C2 | 1/2006 | |
| TW | 200528038 | | 9/2005 | |
| TW | 200946241 | A1 | 11/2009 | |
| WO | 2009/007258 | A1 | 1/2009 | |
| WO | 2009/022232 | A2 | 2/2009 | |
| WO | WO 2013/104616 | A1 | 7/2013 | |

OTHER PUBLICATIONS

Combined Chinese Office Action and Search Report dated Nov. 16, 2015 in Patent Application No. 201380063377.5 (with English language translation).

Office Action dated Nov. 9, 2015 in Japanese Patent Application No. 2015-546041 (with English language translation).

English translation only of Taiwanese Office Action dated Sep. 28, 2017 in corresponding Taiwanese Patent Application No. 102144737, (7 pages).

"Decision on Grant" dated Nov. 23, 2017 (and English translation) in corresponding Russian Patent Application No. 2015127085, (10 pages).

International Search Report dated May 16, 2014 in PCT/EP2013/075855 filed Dec. 6, 2013.

* cited by examiner

SMOKING ARTICLE WITH REMOVABLE CAP

CROSS REFERENCE TO RELATED APPLICATION

This application is a U.S. national phase application under 35 U.S.C. § 317 of PCT/EP2013/075855, filed on Dec. 6, 2013, and claims the benefit of priority under 35 U.S.C. § 119 from prior EP Application No. 12196141.1, filed on Dec. 7, 2012, the entire contents of each of which are incorporated herein by reference.

The present invention relates to a smoking article comprising a heat source and an aerosol-forming substrate adjacent to the heat source, the smoking article having a removable cap for protecting the heat source.

A number of smoking articles in which tobacco is heated rather than combusted have been proposed in the art. One aim of such 'heated' smoking articles is to reduce known harmful smoke constituents of the type produced by the combustion and pyrolytic degradation of tobacco in conventional cigarettes. In one known type of heated smoking article, an aerosol is generated by the transfer of heat from a combustible heat source to an aerosol-forming substrate located downstream of the combustible heat source. During smoking, volatile compounds are released from the aerosol-forming substrate by heat transfer from the combustible heat source and entrained in air drawn through the smoking article. As the released compounds cool, they condense to form an aerosol that is inhaled by the user. Typically, air is drawn into such known heated smoking articles through one or more airflow channels provided through the combustible heat source and heat transfer from the combustible heat source to the aerosol-forming substrate occurs by forced convection (i.e., puffing) and conduction.

For example, WO-A2-2009/022232 A1 discloses a smoking article comprising a combustible heat source, an aerosol-forming substrate downstream of the combustible heat source, and a heat-conducting element around and in direct contact with a rear portion of the combustible heat source and an adjacent front portion of the aerosol-forming substrate. To provide a controlled amount of forced convective heating of the aerosol-forming substrate, at least one longitudinal airflow channel is provided through the combustible heat source.

Known heat sources are generally manufactured from brittle materials, such as a compressed particulate material, that may have a tendency to splinter, crumble, or fragment, during manufacture of smoking articles, during packing, during transportation, and during handling by the user. Such a break-down of the heat source may dirty other components of the smoking article, other smoking articles, or the user with dust, which is undesirable.

Furthermore, known heat sources, especially when manufactured from compressed particulate material, may absorb moisture from the atmosphere, depending on the atmospheric conditions, which may make the heat sources more susceptible to breaking. In addition, when the heat source is combustible, moisture absorbed from the atmosphere may make the heat source more difficult to ignite. The moisture in the heat source may additionally hinder the heating performance of the heat source, so as to reach a satisfactory time to first puff or to provide sufficient energy over the desired duration of the smoking experience.

Smoking articles having a paper wrapper covering the heat source are known, but the paper wrapper can be difficult to cleanly separate from the smoking article by the user and may stain the user's hands during removal. In smoking articles where the paper wrapper should be removed before ignition of the heat source, these drawbacks can cause the user to leave the paper wrapper intact during lighting of the heat source. The paper wrapper left around the heat source may inhibit ignition and make it more difficult to maintain combustion of the heat source. Additionally, the paper may ignite, create flames, ash, and unwanted smoke.

It is therefore an object of the present invention to provide a smoking article having a heat source that is more hygienic. A further object of the present invention is to provide a smoking article having a heat source that is less prone to breakage during manufacture, handling, and storage. In other aspects, it is an object of the present invention to provide a smoking article having a heat source that is easier to light. In additional other aspects, it is an object of the present invention to provide a smoking article having a heat source that is less likely to generate flames, ash, and unwanted smoke from the paper wrapper around the heat source. In addition, it is an object of the present invention to provide a smoking article having a heat source that is easier to manufacture.

According to the present invention, there is provided a smoking article having a mouth end and a distal end. The smoking article comprises a combustible carbonaceous heat source positioned at the distal end, and an aerosol-forming substrate adjacent to the heat source. The smoking article further comprises a cap configured to at least partially cover the heat source. The cap is attached at a line of weakness to the distal end of the smoking article, comprises a cylindrical plug of material circumscribed by a wrapper and is removable to expose the heat source prior to use of the smoking article.

By providing a removable cap, the heat source of the smoking article is advantageously more protected than a heat source in a smoking article without a cap. As such, the heat source is less prone to breakage, and is easier to handle during manufacture, transport, and use. The removable cap being attached at a line of weakness advantageously allows the cap to be removed easily by the user prior to use of the smoking article without undue burden.

Furthermore, providing a removable cap enables the heat source to remain in a more stable atmosphere to reduce the amount of moisture absorbed by the heat source during transportation and storage.

As used herein, the term 'cap' refers to a protective cover that substantially surrounds the distal end of the smoking article, including the end face. Providing a removable cap that is removed prior to ignition of the smoking article may lead to a reduction in sidestream smoke from the smoking article compared to a smoking article having a heat source that is covered by a paper wrapper during ignition. By providing the removable cap, the user is inhibited from readily igniting the heat source until the cap is removed, unlike paper wrappers, which do not prevent or obstruct the user from igniting the heat source while the paper wrapper remains intact and covering the heat source. Similarly, providing a removable cap that is removed prior to ignition of the smoking article may lead to a reduction in ash generation and flaming compared to smoking articles with a paper wrapper that covers the heat source during ignition. If present, a paper wrapper can burn rapidly leading to flaming and generation of ash when the smoking article is ignited. The removable cap may enable a more hygienic smoking article to be provided. In addition, the cap reduces the risk of the user coming into direct contact with the heat source, and so reduces the risk that the heat source will soil the user's clothes or hands. The removable cap may additionally provide protection of the heat source from external contaminants.

Similarly, during manufacture, the provision of the removable cap advantageously reduces the risk of the heat source dirtying the manufacturing equipment, and staining adjacent smoking articles. In effect, the removable cap acts to isolate the heat source from the surrounding equipment and smoking articles. In addition, it provides physical protection during manufacture to help prevent the heat source from breaking or chipping off.

In a preferred embodiment, the aerosol-forming substrate is downstream of the heat source. In an alternative embodiment, the aerosol-forming substrate may be positioned concentrically within or around the heat source.

As used herein, the terms 'upstream' and 'front', and 'downstream' and 'rear', are used to describe the relative positions of segments or components of the smoking article in relation to the direction in which a user draws on the smoking article during use thereof. Smoking articles according to the invention comprise a mouth end and an opposed distal end. In use, a user draws on the mouth end of the smoking article. The mouth end is downstream of the distal end. The heat source is located at or proximate to the distal end.

In the preferred embodiment, the wrapper further circumscribes at least a further portion of the smoking article and the line of weakness is provided in the wrapper. The wrapper enables the cap to be attached to the smoking article during manufacture. To enable the cap to be removed more easily, the wrapper is preferably affixed to the cap and at least a further portion of smoking article, remote from the line of weakness. By affixing the wrapper remote from the line of weakness, the line of weakness may be more easily broken when the user wants to remove the cap. The wrapper is preferably affixed using glue. The glue may be provided in an elongate line extending from proximate the distal end of the smoking article towards the mouth end of the smoking article. When the glue is provided in an elongate line, the line of glue may be interrupted proximate to the line of weakness and is positioned such that it does not inhibit the removal of the cap from the smoking article. In certain preferred embodiments, the wrapper affixed to the cap extends to circumscribe the entire smoking article. In other words, one wrapper comprising a line of weakness is used to circumscribe the smoking article of the invention. In other alternative preferred embodiments, a first wrapper comprising a line of weakness may be affixed to the cap and extends to further circumscribe a portion, but not all, of the smoking article. A second wrapper downstream from the first wrapper may be used to circumscribe segments of the smoking article that are downstream from the first wrapper.

The removable cap is preferably annular or ring shaped, though in alternative embodiments, it may be solid or shaped as a hollow cup. In the preferred embodiment, the cap has substantially the same diameter as the heat source. The cap is preferably cylindrical. The cap may be compressible or non-compressible, and manufactured from material suitable for protecting the heat source.

In embodiments where the cap is non-compressible, it may be made from any suitably stiff material, such as cardboard, metal, plastic, glass, clay, or combinations thereof. In use, the material holding the cap to the smoking article may be broken, for example, by twisting or pulling the non-compressible removable cap.

Preferably, the removable cap is compressible along at least the transverse axis of the smoking article. By providing a compressible cap, the line of weakness may be more easily broken by the user. The cap is preferably compressible by the user, and may be compressed by between about 10% and about 50% when the user applies a pinching force to the cap. In this embodiment, when the user applies the pinching force, the cap compresses and places stresses on the line of weakness sufficient to locally break the material holding the cap to the smoking article adjacent the position the force is applied. The user may then pull, bend, and/or twist the cap about the longitudinal axis of the smoking article to break any remaining material holding the cap to the smoking article and facilitate removal of the cap. As used herein, the term 'longitudinal' refers to the direction along the length of the smoking article. The term "transverse" refers to a direction perpendicular to the longitudinal direction.

In alternative embodiments of the invention, a pull-tab is provided in a seam of the wrapper, proximate the line of weakness and/or the longitudinal line of weakness to facilitate removal of the cap from the smoking article by allowing the user to break the line of weakness.

In certain preferred embodiments, the removable cap may be manufactured from the same material as another segment of the smoking article. By manufacturing the cap from such a material, the manufacturing process may be more efficient. The cap is preferably made from the same material as an elongate segment provided downstream of the aerosol-forming substrate.

As used herein, the term "elongate segment" is used to describe any portion of a smoking article downstream from the aerosol-forming substrate, which adds to the length of the smoking article. By way of example, half the length of a transfer section, comprised of a hollow cellulose acetate tube, to help transfer aerosols from the aerosol-forming substrate to the mouthpiece of the smoking article, could be one embodiment of an elongate segment to form the removable cap. In certain embodiments, the elongate segment may comprise an entire segment of a smoking article, such as, for example a transfer segment or mouthpiece filter segment. In alternative embodiments, as described above, the elongate segment may comprise only a portion of a segment of a smoking article. In further alternative embodiments, the elongate segment is comprised of a component of smoking article, comprising two or more segments of the smoking article. In yet further alternative embodiments, the elongate segment is comprised of a component of smoking article, comprising a segment of a smoking article plus a portion of a second segment of a smoking article.

The elongate segment may be compressible or not compressible. In the preferred embodiment, the elongate segment is a portion of an airflow directing element comprising a hollow cylindrical portion, and an air permeable annular portion surrounding the hollow cylindrical portion. As such, in this preferred embodiment, the cap comprises a hollow cylindrical portion and an air permeable annular portion surrounding the hollow cylindrical portion. In alternative embodiments, the elongate segment comprises a hollow cylindrical portion, and an air impermeable annular portion surrounding the hollow cylindrical portion. In further alternative embodiments, the elongate segment comprises an impermeable cylindrical portion, and an air permeable annular portion surrounding the impermeable cylindrical portion. Alternatively, the elongate segment comprises an air permeable cylindrical portion, and an air permeable annular portion surrounding the permeable cylindrical portion.

In certain preferred embodiments, the removable cap may comprise a desiccant. The desiccant is provided to absorb moisture from the atmosphere to prevent or reduce the amount of moisture absorption by the heat source. Advantageously, reducing the amount of moisture absorbed by the heat source may provide a smoking article that is easier to light. The desiccant may be a substance that is soluble or insoluble in water, including but not limited to glycerin, calcium chloride, calcium sulfate, silica gel, zeolites, molecular sieves, aluminium sulphate, Montmorillonite clay, calcium oxide, clay, and activated carbon, or any combination thereof.

The line of weakness is preferably positioned proximate to the downstream end of the heat source. By providing the line of weakness in this position, when the cap is removed the heat source is sufficiently exposed such that only the heat source substantially burns during use. Preferably, the line of weakness is positioned so that none of the wrapper around the remainder of the smoking article after removal of the cap burns during use.

In one embodiment, a heat conducting element is provided which circumscribes at least a downstream portion of the heat source, and at least an upstream portion of the aerosol-forming substrate. The line of weakness is preferably positioned adjacent to the heat conducting element. In certain preferred embodiments, the wrapper that is connected to the cap at least partially directly overlies the heat conducting element and the line of weakness is positioned so that when the cap is removed from the smoking article, the heat conducting element is at least partially exposed. In an alternative preferred embodiment, the wrapper connected to the cap at least partially overlies an underlying heat conducting element, which is radially separated from the wrapper connected to the cap by at least one intermediate layer of material, such as another paper wrapper. In a further alternative preferred embodiment, the line of weakness is positioned adjacent to the upstream edge of the heat conducting element. In other alternative embodiments, the line of weakness is positioned adjacent to the downstream edge of the heat conducting element.

The heat conducting element provides a thermal link between the heat source and aerosol-forming substrate of smoking articles according to the invention. The heat conducting element is preferably combustion resistant and oxygen restricting. Suitable heat-conducting elements for use in smoking articles according to the invention include, but are not limited to: graphite sheet, metal foil wrappers such as, for example, aluminium foil wrappers, steel wrappers, iron foil wrappers and copper foil wrappers; and metal alloy foil wrappers.

The rear portion of the combustible heat source surrounded by the heat-conducting element is preferably between about 2 mm and about 8 mm in length, more preferably between about 3 mm and about 5 mm in length.

Preferably, the front portion of the combustible heat source not surrounded by the heat-conducting element is between about 4 mm and about 15 mm in length, more preferably between about 4 mm and about 8 mm in length.

The line of weakness preferably circumscribes at least a portion of the smoking article. In a preferred embodiment, the line of weakness circumscribes substantially the whole circumference of the smoking article.

Preferably, the line of weakness comprises a plurality of perforations which circumscribe the smoking article. Alternatively, the line of weakness may comprise a scribed or scored line reducing the strength of the material, or a section of different, weaker, material.

The removable cap may comprise visible indicia. The term 'indicia' is used to refer to a discrete printed element, or repeating printed elements or patterns that provide an aesthetically pleasing representation. The indicia may be in the form of text, images, letters, words, logos, patterns or a combination thereof. In a preferred embodiment, the indicia provide instructions to the user on how to remove the removable cap. In an alternative embodiment, the indicia may, for example, comprise a brand or manufacturer logo that allows the consumer to identify the type or origin of the smoking article. Alternatively, the indicia may comprise a repeating printed element or pattern on the inner surface of the wrapper. The indicia may be generally aligned with an axis of the smoking article. For example, the indicia may be aligned perpendicular or parallel to the longitudinal axis of the smoking article. Alternatively, the indicia may be aligned at an angle other than parallel or perpendicular to the longitudinal axis of the smoking article. In addition, different indicia could be provided on a number of smoking articles that are sold together. For example, in one package the smoking articles may include two or more different types of indicia. In addition, the indicia could be presented in a way that presents a message, for example with the indicia on adjacent smoking articles in a package which is visible when the packaging is opened and the visible indicia spelling a word or otherwise collectively conveying a message.

In certain preferred embodiments, the line of weakness circumscribes at least a portion of the smoking article and the wrapper may comprise at least one longitudinal line of weakness. In this arrangement, the at least one longitudinal line of weakness is preferably positioned such that it extends longitudinally from adjacent the distal end towards the mouth end. By providing such a longitudinal line of weakness, the user may more easily remove the wrap by first tearing along the at least one longitudinal line of weakness, and then along the line of weakness that circumscribes the smoking article, where the cap is attached, to remove the cap.

In such embodiments, the at least one longitudinal line of weakness may intersect or merge with the line of weakness at which the cap is attached. Alternatively, the at least one longitudinal line of weakness may terminate proximate to the line of weakness at which the cap is attached. Preferably, the at least one longitudinal line of weakness has a length of from about 3 mm to about 13 mm, more preferably of from about 5 mm to about 10 mm, and most preferably of about 8 mm.

In certain preferred embodiments, the at least one longitudinal line of weakness comprises a plurality of perforations which extend along the smoking article. Alternatively, the longitudinal line of weakness may comprise a scribed or scored line reducing the strength of the material, or a section of different, weaker, material. As a further alternative, the longitudinal line of weakness may comprise a cut extending through the entire thickness of the wrapper.

The at least one longitudinal line of weakness may be linear or non-linear. The non-linear line of weakness may be a smooth wave, a triangular wave or any other suitable non-linear line. In one preferred embodiment, the non-linear line comprises a semi-circle.

As described above, the heat source is a combustible carbonaceous heat source. As used herein, the term 'carbonaceous' is used to describe a combustible heat source comprising carbon.

Preferably, combustible carbonaceous heat sources for use in smoking articles according to the invention have a carbon content of at least about 35 percent, more preferably of at least about 40 percent, most preferably of at least about 45 percent by dry weight of the combustible heat source.

In some embodiments, combustible heat sources according to the invention are combustible carbon-based heat sources. As used herein, the term 'carbon-based heat source' is used to describe a heat source comprised primarily of carbon.

Combustible carbon-based heat sources for use in smoking articles according to the invention have a carbon content of at least about 50 percent, preferably of at least about 60 percent, more preferably of at least about 70 percent, most preferably of at least about 80 percent by dry weight of the combustible carbon-based heat source.

Smoking articles according to the invention may comprise combustible carbonaceous heat sources formed from one or more suitable carbon-containing materials.

If desired, one or more binders may be combined with the one or more carbon-containing materials. Preferably, the one or more binders are organic binders. Suitable known organic binders, include but are not limited to, gums (for example, guar gum), modified celluloses and cellulose derivatives (for example, methyl cellulose, carboxymethyl cellulose, hydroxypropyl cellulose and hydroxypropyl methylcellulose) flour, starches, sugars, vegetable oils and combinations thereof.

Instead of, or in addition to one or more binders, combustible heat sources for use in smoking articles according to the invention may comprise one or more additives in order to improve the properties of the combustible heat source. Suitable additives include, but are not limited to, additives to promote consolidation of the combustible heat source (for example, sintering aids), additives to promote ignition of the combustible heat source (for example, oxidisers such as perchlorates, chlorates, nitrates, peroxides, permanganates, zirconium and combinations thereof), additives to promote combustion of the combustible heat source (for example, potassium and potassium salts, such as potassium citrate) and additives to promote decomposition of one or more gases produced by combustion of the combustible heat source (for example catalysts, such as CuO, $Fe_2O_3$ and $Al_2O_3$).

Smoking articles according to the invention may comprise heat sources that are blind or non-blind. As used herein, the term 'blind' is used to describe a heat source of a smoking article according to the invention in which air drawn through the smoking article for inhalation by a user does not pass through any airflow channels along the heat source.

As used herein, the term 'non-blind' is used to describe a heat source of a smoking article according to the invention in which air drawn through the smoking article for inhalation by a user passes through one or more airflow channels along the heat source.

In embodiments where the heat source is a combustible heat source, to isolate the combustible heat source from air drawn through the smoking article, smoking articles according to the invention may comprise a non-combustible, substantially air impermeable, barrier between a downstream end of the combustible heat source and an upstream end of the aerosol-forming substrate.

As used herein, the term 'non-combustible' is used to describe a barrier that is substantially non-combustible at temperatures reached by the combustible heat source during combustion or ignition thereof.

The barrier may abut one or both of the downstream end of the combustible heat source and the upstream end of the aerosol-forming substrate.

The barrier may be adhered or otherwise affixed to one or both of the downstream end of the combustible heat source and the upstream end of the aerosol-forming substrate.

In some embodiments, the barrier comprises a barrier coating provided on a rear face of the combustible heat source. In such embodiments, preferably the first barrier comprises a barrier coating provided on at least substantially the entire rear face of the combustible heat source. More preferably, the barrier comprises a barrier coating provided on the entire rear face of the combustible heat source.

As used herein, the term 'coating' is used to describe a layer of material that covers and is adhered to the combustible heat source.

The thickness of the barrier may be appropriately adjusted to achieve good smoking performance. In certain embodiments, the barrier may have a thickness of between about 10 microns and about 500 microns.

The barrier may be formed from one or more suitable materials that are substantially thermally stable and non-combustible at temperatures achieved by the combustible heat source during ignition and combustion. Suitable materials are known in the art and include, but are not limited to, clays (such as, for example, bentonite and kaolinite), glasses, minerals, ceramic materials, resins, metals and combinations thereof.

Preferred materials from which the barrier may be formed include clays and glasses. More preferred materials from which the barrier may be formed include copper, aluminium, stainless steel, alloys, alumina ($Al_2O_3$), resins, and mineral glues.

Where the barrier comprises a barrier coating provided on a rear face of the combustible heat source, the barrier coating may be applied to cover and adhere to the rear face of the combustible heat source by any suitable methods known in the art including, but not limited to, spray-coating, vapour deposition, dipping, material transfer (for example, brushing or gluing), electrostatic deposition or any combination thereof.

For example, the barrier coating may be made by preforming a barrier in the approximate size and shape of the rear face of the combustible heat source, and applying it to the rear face of the combustible heat source to cover and adhere to at least substantially the entire rear face of the combustible heat source. Alternatively, the first barrier coating may be cut or otherwise machined after it is applied to the rear face of the combustible heat source. In one preferred embodiment, aluminium foil is applied to the rear face of the combustible heat source by gluing or pressing it to the combustible heat source, and is cut or otherwise machined so that the aluminium foil covers and adheres to at least substantially the entire rear face of the combustible heat source, preferably to the entire rear face of the combustible heat source.

Preferably, the combustible heat source has a length of between about 7 mm and about 17 mm, more preferably of between about 7 mm and about 15 mm, most preferably of between about 7 mm and about 13 mm.

Preferably, the combustible heat source has a diameter of between about 5 mm and about 9 mm, more preferably of between about 7 mm and about 8 mm.

Preferably, the heat source is of substantially uniform diameter. However, the heat source may alternatively be tapered so that the diameter of the rear portion of the heat source is greater than the diameter of the front portion thereof. Particularly preferred are heat sources that are substantially cylindrical. The heat source may, for example, be a cylinder or tapered cylinder of substantially circular cross-section or a cylinder or tapered cylinder of substantially elliptical cross-section.

The heat source and aerosol-forming substrate of smoking articles according to the invention may substantially abut one another. Alternatively, the heat source and aerosol-forming substrate of smoking articles according to the invention may be longitudinally spaced apart from one another.

Preferably, the aerosol-forming substrate has a length of between about 5 mm and about 20 mm, more preferably of between about 8 mm and about 12 mm.

In certain preferred embodiments where a heat conducting element is provided, the aerosol-forming substrate extends at least about 3 mm downstream beyond the heat-conducting element.

Where a heat conducting element is provided, preferably, the front portion of the aerosol-forming substrate surrounded by the heat conducting element is between about 2 mm and about 10 mm in length. Preferably, the rear portion of the aerosol-forming substrate not surrounded by the heat conducting element is between about 3 mm and about 10 mm in length. In other words, the aerosol-forming substrate preferably extends between about 3 mm and about 10 mm downstream beyond the heat conducting element.

In yet further embodiments, the entire length of the aerosol-forming substrate may be surrounded by the heat-conducting element.

Preferably, smoking articles according to the invention comprise aerosol-forming substrates comprising a material capable of emitting volatile compounds in response to heating. Preferably, the material capable of emitting volatile compounds in response to heating is a charge of plant-based material, more preferably a charge of homogenised plant-based material. For example, the aerosol-forming substrate may comprise one or more materials derived from plants including, but not limited to: tobacco; tea, for example green tea; peppermint; laurel; eucalyptus; basil; sage; verbena; and tarragon. The plant based-material may comprise additives including, but not limited to, humectants, flavourants, binders and mixtures thereof. Preferably, the plant-based material consists essentially of tobacco material, most preferably homogenised tobacco material.

In a preferred embodiment, the aerosol-forming substrate further comprises at least one aerosol-former. The at least one aerosol-former may be any suitable known compound or mixture of compounds that, in use, facilitates formation of a dense and stable aerosol and that is substantially resistant to thermal degradation at the operating temperature of the aerosol-generating article.

Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol and, most preferred, glycerine.

In certain alternative preferred embodiments, the aerosol-forming substrate may be non-plant based. In such embodiments, the aerosol-forming substrate may be made from any material that is capable of being impregnated with a volatile compound in response to heating, and is thermally stable at the temperature range reached upon heating by the heat source. Volatile compounds, such as nicotine, flavourants, and other aerosol modifiers and additives or combinations thereof, may be incorporated into the non-plant based aerosol-forming substrate.

Smoking articles according to the invention may also further comprise an airflow directing element downstream of the aerosol-forming substrate and a mouthpiece downstream of an expansion chamber, which is downstream of the airflow directing element. Preferably, the mouthpiece is of low filtration efficiency, more preferably of very low filtration efficiency. The mouthpiece may be a single segment or component mouthpiece. Alternatively, the mouthpiece may be a multi-segment or multi-component mouthpiece.

The mouthpiece may, for example, comprise a filter made of cellulose acetate, paper or other suitable known filtration materials. Alternatively or in addition, the mouthpiece may comprise one or more segments comprising absorbents, adsorbents, flavourants, for example a capsule containing flavourants, and other aerosol modifiers and additives or combinations thereof.

Features described in relation to one aspect of the invention may also be applicable to other aspects of the invention. In particular, features described in relation to smoking articles and combustible heat sources according to the invention may also be applicable to methods according to the invention.

An embodiment of a smoking article according to the present invention will now be further described, by way of example only, with reference to the accompanying drawing in which.

Figure 1:
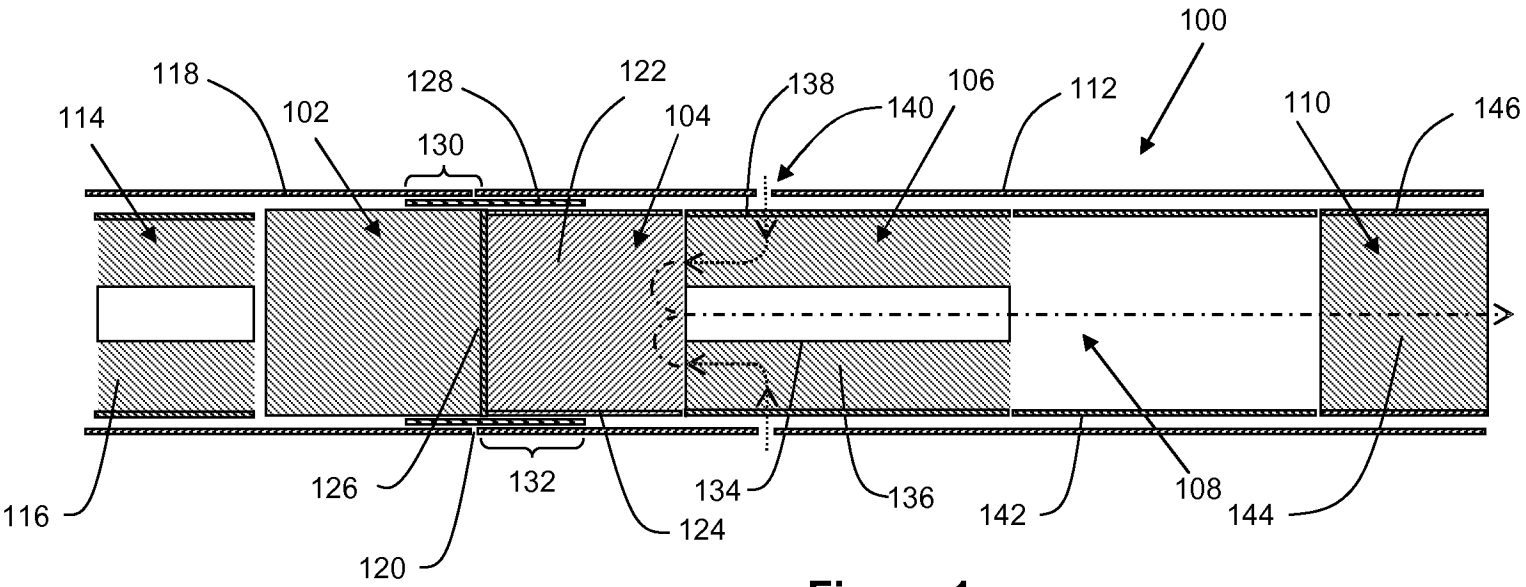
FIG. 1 shows a schematic longitudinal cross-sectional view of a smoking article according to the present invention.

The smoking article 100 according to the first embodiment of the invention shown in FIG. 1 comprises a blind combustible carbonaceous heat source 102, an aerosol-forming substrate 104, an airflow directing element 106, an expansion chamber 108 and a mouthpiece 110 in abutting coaxial alignment. The combustible carbonaceous heat source 102, aerosol-forming substrate 104, airflow directing element 106, elongate expansion chamber 108 and mouthpiece 110 are overwrapped in an outer wrapper 112 of cigarette paper of low air permeability.

A removable cap 114 is provided at the distal end of the smoking article 100, and is directly adjacent to the heat source 102. The removable cap 114 comprises a central portion 116, and is wrapped in a portion 118 of the outer wrapper 112. In the embodiment shown, the central portion 116 comprises a desiccant, such as glycerine, provided to preferentially absorb moisture as compared to the heat source. The portion 118 of the outer wrapper is connected to the main outer wrapper 112 along a line of weakness 120. The line of weakness comprises a plurality of perforations that circumscribe the smoking article 100.

The aerosol-forming substrate 104 is located immediately downstream of the combustible carbonaceous heat source 102 and comprises a cylindrical plug 122 of tobacco material comprising glycerine as aerosol former and circumscribed by plug wrap 124.

A non-combustible, substantially air impermeable barrier 126 is provided between the downstream end of the combustible heat source 102 and the upstream end of the aerosol-forming substrate 104. As shown in FIG. 1, the non-combustible, substantially air impermeable barrier consists of a non-combustible, substantially air impermeable, barrier coating 126, which is provided on the entire rear face of the combustible carbonaceous heat source 102.

A heat conducting element 128 consisting of a tubular layer of aluminium foil surrounds and is in direct contact with a rear portion 130 of the combustible carbonaceous heat source 102 and an abutting front portion 132 of the aerosol-forming substrate 104. As shown in FIG. 1, a rear portion of the aerosol-forming substrate 104 is not surrounded by the heat conducting element 128.

As shown in FIG. 1, the portion 118 of the outer wrapper which forms part of the removable cap may overlay the rear portion 130 of the heat source 102.

The airflow directing element 106 is located downstream of the aerosol-forming substrate 104 and comprises an open-ended, substantially air impermeable hollow tube 134 made of, for example, cardboard, which is of reduced diameter compared to the aerosol-forming substrate 104. The upstream end of the open-ended hollow tube 134 abuts the aerosol-forming substrate 104. The open-ended hollow tube 134 is circumscribed by an annular air permeable diffuser 136 made of, for example, cellulose acetate tow, which is of substantially the same diameter as the aerosol-forming substrate 104.

The open-ended hollow tube 134, and annular air permeable diffuser 136 may be separate components that are adhered or otherwise connected together to form the airflow directing element 106 prior to assembly of the smoking article 100. In yet further embodiments, the open-ended hollow tube 134 and annular air permeable diffuser 136 may be parts of a single component. For example, the open-ended hollow tube and annular air permeable diffuser may be parts of a single hollow tube of air permeable material having a substantially air impermeable coating applied to its inner surface.

In a particularly preferred embodiment the central portion 116 of the removable cap 114 is manufactured from the same material as the airflow directing element, and so comprises an open-ended substantially air impermeable hollow tube circumscribed by an annular air permeable diffuser.

As shown in FIG. 1, the open-ended hollow tube 134 and annular air permeable diffuser 136 are circumscribed by an air permeable inner wrapper 138.

As also shown in FIG. 1, a circumferential arrangement of air inlets 140 is provided in the outer wrapper 112 circumscribing the inner wrapper 138.

The expansion chamber 108 is located downstream of the airflow directing element 106 and comprises an open-ended hollow tube 142 made of, for example, cardboard, which is of substantially the same diameter as the aerosol-forming substrate 104.

The mouthpiece 110 of the smoking article 100 is located downstream of the expansion chamber 108 and comprises a cylindrical plug 144 of cellulose acetate tow of very low filtration efficiency circumscribed by filter plug wrap 146. The mouthpiece 110 may be circumscribed by tipping paper (not shown). In addition, an aerosol cooling segment may be provided upstream of the mouthpiece 110. The aerosol-cooling segment preferably has a large surface area, but causes a low pressure drop, and preferably has a porosity in the longitudinal direction of greater than 50%. The aerosol-cooling segment may be a gathered sheet or a crimped and gathered sheet, and may comprise a sheet material selected from the group consisting of polyethylene (PE), polypropylene (PP), polyvinylchloride (PVC), polyethylene terephthalate (PET), polylactic acid (PLA), cellulose acetate (CA), and aluminium foil. In the preferred embodiment, the aerosol-cooling segment comprises a sheet of PLA, more preferably a crimped, gathered sheet of PLA. In general, this preferred aerosol-cooling segment may be referred to as a PLA filter.

In use, the user removes the removable cap by transversely compressing the cap by pinching it between thumb and finger. By compressing the cap, sufficient force is provided to the line of weakness to locally break the wrapper material. The user then removes the cap by twisting the cap to break the remaining portion of the line of weakness. When the cap is removed the heat source is partially exposed which enables the user to light the smoking article.

Figure 2:
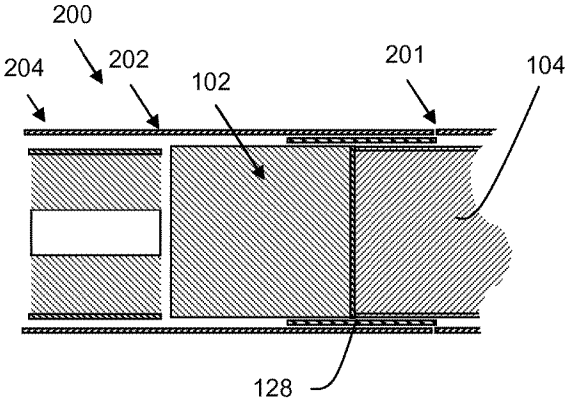
FIG. 2 shows a schematic longitudinal cross-sectional view in the region of the line of weakness of an alternative smoking article according to the present invention.

As will be appreciated, from FIGS. 1, 2, 3 and 4, the line of weakness may be provided at any appropriate position along the heat conducting element. An alternative embodiment of a smoking article 200 according to the present invention is shown in FIG. 2. Only the distal end of the smoking article is shown for convenience, and the remaining components of the smoking article are substantially identical to those described with reference to FIG. 1.

In this example, the line of weakness 201 is provided at a position which is substantially aligned with the downstream end of the heat conducting element 128. As such, the portion of the outer wrapper 202 which forms part of the removable cap 204 extends further along the longitudinal length of the smoking article than the example shown in FIG. 1. In this way, when the removable cap is removed by the user the heat conducting element is exposed.

Figure 3:
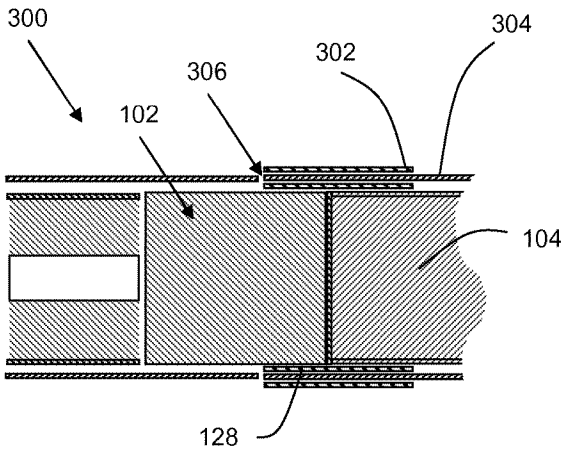
FIG. 3 shows a schematic longitudinal cross-sectional view in the region of the line of weakness of a further alternative smoking article according to the present invention.
Figure 4:
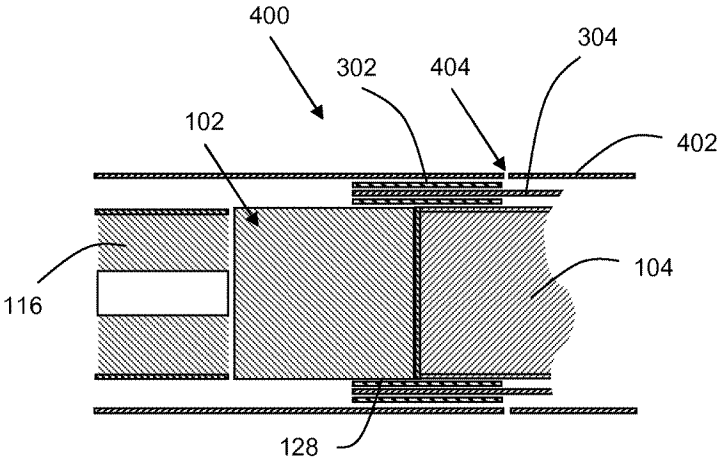
FIG. 4 shows a schematic longitudinal cross-sectional view in the region of the line of weakness of a yet further alternative smoking article according to the present invention.

As shown in FIGS. 3 and 4, smoking articles 300 and 400 of the present invention may further comprise a second heat-conducting element 302 consisting of a tube of aluminium foil which surrounds and is in contact with the outer wrapper 304. The second heat-conducting element 302 is positioned over the first heat-conducting element 128. The second heat-conducting element directly overlies at least a portion of the first heat-conducting element 128, with the outer wrapper 304 between them.

The second heat-conducting element 302 retains heat within the smoking article 300 to help maintain the temperature of the first heat-conducting element 128 during smoking. This in turn helps maintain the temperature of the aerosol-forming substrate 104 to facilitate continued and enhanced aerosol delivery.

FIG. 3 shows an example of a smoking article 300 according to the invention, where the line of weakness 306 is provided at a position adjacent the upstream edge of the second heat conducting element. In this example, the second heat conducting element is exposed, even when the removable cap is attached to the smoking article. Similarly to the example shown in FIG. 1, the heat source is partially exposed when the removable cap is removed from the smoking article.

FIG. 4 shows a yet further example of a smoking article 400 according to the invention, where the outer wrapper 402 extends from the distal end of the removable cap towards the mouth-end of the smoking article. The outer wrapper 402 has sufficient length that it wraps the central portion 116 of the cap, the heat source 102, the first and second heat conducting elements 128, 302, and at least a portion of the aerosol-forming substrate 104 not covered by the heat conducting elements. As can be seen, the line of weakness 404 is provided at the downstream end of the second heat conducting element. In this way, the second heat conducting element is not exposed when the removable cap is attached to the smoking article. When the cap is removed the second heat conducting element is exposed, and the heat source is partially exposed.

In further embodiments (not shown), the portion of the outer wrapper around the central portion of the cap is connected to the main outer wrapper along a line of weakness circumscribing at least a portion of the smoking article and one or more longitudinal lines of weakness extend from adjacent the distal end of the cap towards the heat source. The one or more longitudinal lines of weakness intersect, merge with, or terminate proximate to the line of weakness by which the cap is connected. Both sets of lines of weakness comprise a plurality of perforations in the wrapper.

The invention claimed is:

1. A smoking article having a mouth end and a distal end, the smoking article comprising:

a combustible carbonaceous heat source disposed at the distal end and comprising carbon and at least one binder;

an aerosol-forming substrate adjacent to the heat source, disposed between the heat source and the mouth end inside of an outer wrapper circumscribing the smoking article; and a removable cap disposed upstream of and directly adjacent to the heat source, the removable cap at the distal end of the smoking article and at least partially covering the heat source, the removable cap comprising a cylindrical plug of material and circumscribed by another wrapper extending longitudinally along the article, the another wrapper partially overlaying a rear portion of the heat source adjacent to the aerosol-forming substrate and being connected to the outer wrapper at a line of weakness circumscribing the article, wherein upon removal, only the heat source is exposed at the distal end of the smoking article.

2. The smoking article according to claim 1, wherein the another wrapper further circumscribes at least a further portion of the smoking article, and wherein the line of weakness is provided in said another wrapper.

3. The smoking article according to claim 2, wherein the another wrapper is affixed to the removable cap and at least a further portion of smoking article, remote from the line of weakness.

4. The smoking article according to claim 1, wherein the removable cap is compressible along at least the transverse axis of the smoking article.

5. The smoking article according to claim 1, wherein the line of weakness comprises a plurality of perforations which circumscribe the smoking article.

6. The smoking article according to claim 1, wherein the removable cap comprises a desiccant.

7. The smoking article according claim 1, wherein the removable cap has substantially the same diameter heat source.

8. The smoking article according to claim 1, further comprising an elongate segment downstream of the aerosol-forming substrate, wherein the removable cap is made from the same material as the elongate segment.

9. The smoking article according to claim 1, wherein the aerosol-forming substrate is downstream of the heat source.

10. The smoking article according to claim 1, wherein the removable cap comprises visible indicia.

11. The smoking article according to claim 1, wherein the line of weakness circumscribes at least a portion of the smoking article and the another wrapper comprises at least one longitudinal line of weakness.

12. The smoking article according to claim 11, wherein the at least one longitudinal line of weakness extends from adjacent to the distal end towards the mouth end.

13. The smoking article according to claim 11, wherein the at least one longitudinal line of weakness intersects or merges with the line of weakness.

14. The smoking article according to claim 11, wherein the at least one longitudinal line of weakness has a length of from about 3 mm to about 13 mm.

* * * * *